US007491251B2

(12) United States Patent
Welygan et al.

(10) Patent No.: US 7,491,251 B2
(45) Date of Patent: Feb. 17, 2009

(54) METHOD OF MAKING A STRUCTURED ABRASIVE ARTICLE

(75) Inventors: Dennis G. Welygan, Woodbury, MN (US); Kyongcheol Lee, Woodbury, MN (US); Louis S. Moren, Mahtomedi, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 221 days.

(21) Appl. No.: 11/243,757

(22) Filed: Oct. 5, 2005

(65) Prior Publication Data

US 2007/0074455 A1 Apr. 5, 2007

(51) Int. Cl.
*B24D 18/00* (2006.01)

(52) U.S. Cl. ..... 51/298; 51/307; 51/308; 51/309; 51/293; 51/295; 51/297; 427/372.2; 427/355; 427/375; 427/379; 427/384; 427/256; 427/261

(58) Field of Classification Search ..... 51/298, 51/307, 308, 309, 293, 295, 297; 427/372.2, 427/355, 375, 379, 384, 256, 261
See application file for complete search history.

(56) References Cited

U.S. PATENT DOCUMENTS

| | | | | |
|---|---|---|---|---|
| 294,766 | A | 3/1884 | Coy | |
| 2,115,897 | A | 5/1938 | Wooddell et al. | |
| 3,041,156 | A | 6/1962 | Rowse et al. | |
| 3,048,482 | A | 8/1962 | Hurst | |
| 3,364,630 | A | 1/1968 | Rusk et al. | |
| 3,605,349 | A | 9/1971 | Anthon | |
| 3,906,684 | A * | 9/1975 | Marshall et al. | 51/295 |
| 4,311,489 | A | 1/1982 | Kressner | |
| 4,314,827 | A | 2/1982 | Leitheiser et al. | |
| 4,486,200 | A | 12/1984 | Heyer et al. | |
| 4,606,154 | A | 8/1986 | Herrmann et al. | |
| 4,623,364 | A | 11/1986 | Cottringer et al. | |
| 4,644,703 | A | 2/1987 | Kaczmarek et al. | |
| 4,652,275 | A | 3/1987 | Bloecher et al. | |
| 4,744,802 | A | 5/1988 | Schwabel | |
| 4,770,671 | A | 9/1988 | Monroe et al. | |
| 4,773,920 | A | 9/1988 | Chasman et al. | |
| 4,799,939 | A | 1/1989 | Bloecher et al. | |
| 4,881,951 | A | 11/1989 | Wood et al. | |
| 4,930,266 | A | 6/1990 | Calhoun et al. | |
| 4,997,461 | A | 3/1991 | Markhoff-Matheny et al. | |
| 5,009,675 | A | 4/1991 | Kunz et al. | |
| 5,011,508 | A | 4/1991 | Wald et al. | |
| 5,014,468 | A | 5/1991 | Ravipati et al. | |
| 5,039,311 | A | 8/1991 | Bloecher | |
| 5,042,991 | A | 8/1991 | Kunz et al. | |
| 5,085,671 | A | 2/1992 | Martin et al. | |
| 5,107,626 | A | 4/1992 | Mucci | |
| 5,190,568 | A | 3/1993 | Tselesin | |

(Continued)

FOREIGN PATENT DOCUMENTS

| | | |
|---|---|---|
| EP | 0 702 615 B1 | 10/1997 |

(Continued)

*Primary Examiner*—Michael A Marcheschi
(74) *Attorney, Agent, or Firm*—Bradford B. Wright

(57) ABSTRACT

A method of making an abrasive product includes compacting a cohesive layer of abrasive particles and particulate curable binder precursor prior to forming curable shaped structures, and then at least partially curing the curable binder precursor.

16 Claims, 2 Drawing Sheets

U.S. PATENT DOCUMENTS

| | | | | |
|---|---|---|---|---|
| 5,199,227 | A | 4/1993 | Ohishi | |
| 5,213,591 | A | 5/1993 | Celikkaya et al. | |
| 5,435,816 | A | 7/1995 | Spurgeon et al. | |
| 5,437,754 | A | 8/1995 | Calhoun | |
| 5,500,273 | A | 3/1996 | Holmes et al. | |
| 5,578,098 | A | 11/1996 | Gagliardi et al. | |
| 5,611,827 | A | 3/1997 | Hammarstrom et al. | |
| 5,623,364 | A | 4/1997 | Morooka | |
| 5,672,097 | A | 9/1997 | Hoopman | |
| 5,681,361 | A | 10/1997 | Sanders, Jr. | |
| 5,785,784 | A | 7/1998 | Chesley et al. | |
| 5,786,430 | A | 7/1998 | Kaplan et al. | |
| 5,872,192 | A | 2/1999 | Kaplan et al. | |
| 5,976,204 | A | 11/1999 | Hammarstrom et al. | |
| 6,051,646 | A * | 4/2000 | Nass et al. | 428/174 |
| 6,093,335 | A | 7/2000 | Bhatt et al. | |
| 6,162,117 | A | 12/2000 | Vo | |
| 6,228,133 | B1 | 5/2001 | Thurber et al. | |
| 6,299,508 | B1 | 10/2001 | Gagliardi et al. | |
| 6,833,014 | B2 * | 12/2004 | Welygan et al. | 51/293 |
| 6,969,412 | B2 | 11/2005 | Welygan et al. | |
| 7,044,989 | B2 * | 5/2006 | Welygan et al. | 51/293 |
| 2003/0150169 | A1 * | 8/2003 | Annen | 51/300 |
| 2005/0081455 | A1 | 4/2005 | Welygan et al. | |
| 2005/0107011 | A1 | 5/2005 | Welygan et al. | |
| 2005/0130568 | A1 * | 6/2005 | Welygan et al. | 451/59 |

FOREIGN PATENT DOCUMENTS

| | | |
|---|---|---|
| GB | 2 094 824 A | 9/1982 |
| JP | 2-83172 | 3/1990 |
| JP | 7-237126 | 9/1995 |
| JP | 2868772 | 12/1998 |
| JP | 2977884 | 9/1999 |
| JP | 2000-225679 | 8/2000 |
| JP | 2001-179641 | 7/2001 |
| TW | 456167 | 9/2001 |
| WO | WO 03/099496 A2 | 12/2003 |

* cited by examiner

METHOD OF MAKING A STRUCTURED ABRASIVE ARTICLE

BACKGROUND

Abrasive products are available in any of a variety of types, each generally being designed for specific applications and no particular type providing a universal abrading tool for all applications. The various types of abrasive products include, for example, coated abrasives, bonded abrasives, and low density or nonwoven abrasive products (sometimes called surface conditioning products).

Coated abrasives typically comprise abrasive granules generally uniformly distributed over and adhered to the surface of a flexible backing. Bonded abrasives, a typical example of which is a grinding wheel, generally comprises abrasive material rigidly consolidated together in a mass in the form of a rotatable annulus or other shapes such as a block-shaped honing stone. Low density or nonwoven abrasive products typically include an open, lofty, three-dimensional fiber web impregnated with adhesive which does not alter the open character of the web and also adheres abrasive granules to the fiber surfaces of the web.

Abrasive products are used industrially, commercially, and by individual consumers to prepare any of a variety of materials for use or for further processing. Exemplary uses of abrasive products include preliminary preparation of a surface before priming or painting, cleaning the surface of an object to remove oxidation or debris and grinding or abrading an object to obtain a specific shape. In these applications, abrasive products may be used to grind a surface or workpiece to a certain shape or form, to abrade a surface to clean or to facilitate bonding of a coating such as paint, or to provide a desired surface finish, especially a smooth or otherwise decorative finish.

Abrasive products that have shaped abrasive structures affixed to a backing are commercially available. Such abrasive products may be in the form of, for example, abrasive sheets, belts, or wheels. The shaped abrasive structures generally have abrasive particles and a binder that bonds the abrasive particles together, and typically to the backing.

SUMMARY

In one aspect, the present invention provides a method of making an abrasive product, the method comprising:

a) providing a substantially horizontally deployed backing;

b) providing a dry flowable particle mixture comprising abrasive particles and particulate curable binder precursor, wherein the abrasive particles have an average particle size of 45 microns or less;

c) depositing a layer of the dry flowable particle mixture onto the backing;

d) sintering at least a portion of the layer of the dry flowable particle mixture to provide a cohesive layer wherein adjacent abrasive particles are adhered to one another by the curable binder precursor;

e) compacting the cohesive layer to provide a compacted layer;

f) at least one of embossing or at least partially cutting the compacted layer to provide curable shaped structures having a distal end spaced from the backing and an attachment end adhered to the backing; and g) at least partially curing the curable binder precursor to form shaped abrasive structures comprising abrasive particles and a binder, the shaped abrasive structures being affixed to the backing.

In some embodiments, the method further comprises:

prior to step b)

applying a powdered curable primer to the backing; and sintering the powdered curable primer.

In some embodiments, the backing comprises a scrim. In these embodiments, the method may further comprise:

prior to step c)

providing a substantially horizontally deployed carrier;

disposing the scrim on the carrier; and prior to step g)

separating the scrim from the carrier.

In some embodiments, the method further comprises affixing the backing to a core such that the shaped abrasive structures are outwardly disposed relative to the core.

Shaped abrasive articles prepared according to the present invention typically have shaped abrasive structures that are substantially free of apparent cracks.

As used herein, the term "particulate curable binder precursor" means a plurality of particles which are solid at room temperature, and which may be softened and cured either: 1) upon heating and subsequent cooling, if thermoplastic; or 2) upon sufficient exposure to heat or other suitable energy source, if thermosetting.

DETAILED DESCRIPTION

Figure 1A:
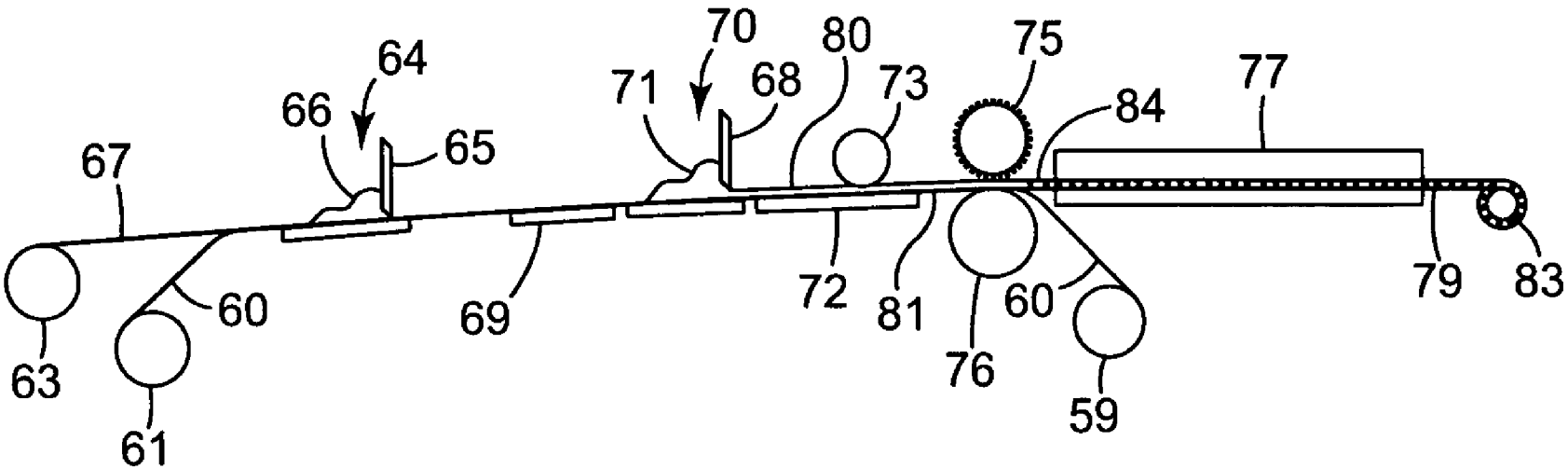
FIG. 1A is a schematic illustration of a process flow diagram of an exemplary method of making an abrasive product according to one embodiment of the present invention.

FIG. 1A shows an exemplary method of making an abrasive product according to the present invention. Referring now to FIG. 1A, backing supply roll 63 dispenses backing 67. In embodiments wherein the backing is a scrim, optional carrier supply roll 61 dispenses carrier 60. In some embodiments, for example, those wherein the backing is not a scrim, backing 67 traverses optional primer coating station 64 and optional heated platen 69. Optional primer coating station 64, supplies optional particulate curable primer onto backing 67. Optional particulate curable primer 66 is metered by optional knife blade 65 onto backing 67, and then sintered by optional heated platen 69.

Coating station 70 supplies a mixture 71 of particulate curable binder precursor and abrasive particles onto backing 67, which may optionally have a layer (not shown) of sintered particulate curable primer 66 thereon. Mixture 71 is metered by knife blade 68 to provide layer 80 of mixture 71 on backing 67. Knife blade 68 may be profiled across its longest dimension and/or may be dynamically vertically adjusted to provide topography to layer 80. In the event that backing 67 is a scrim, it typically becomes embedded in layer 80, forming an integral part thereof. Layer 80, which may be continuous or discontinuous, and which is in effect a sheet of abrasive particles in particulate curable binder precursor, is then sintered as it passes onto and along heated platen 72.

During heating to sinter layer 80, cracking of the layer may occur due to shrinkage of layer 80, which comprises a mixture of curable binder precursor and abrasive particles. Cracking is typically particularly troublesome for fine mineral grades (e.g., mineral grades with an average particle size of about 45 microns or less) and at high curable binder precursor content. This undesirable cracking may extend from the surface of the shaped structures to the backing. If embossed and cured in this condition inferior product may result, for example, with regard to appearance, abrasive performance, and/or product life.

Figure 1B:
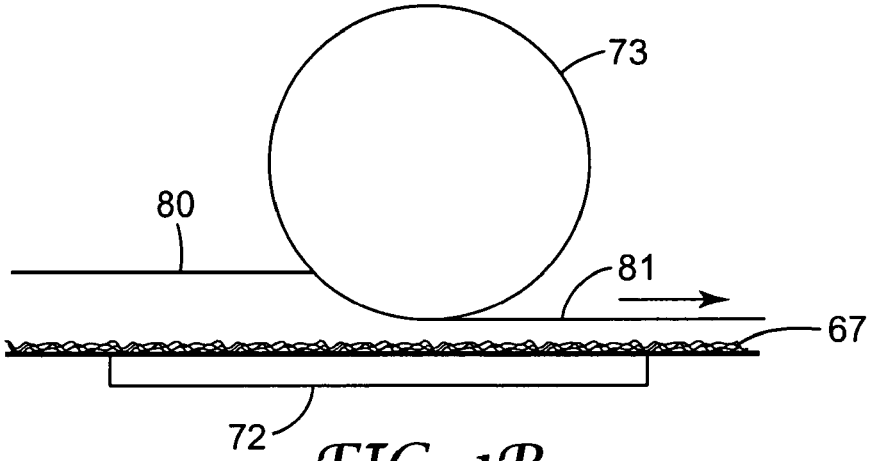
FIG. 1B is an enlarged schematic view of the compaction process step according to one embodiment of the present invention.

Unexpectedly, it is found that if layer 80 is compacted by compacting roll 73 (shown in greater magnification in FIG. 1B), to form compacted layer 81 supported on backing 67, prior to the top surface of the layer being completely fused to the thermoplastic state, cracking can be reduced or even typically eliminated.

Figure 2A:
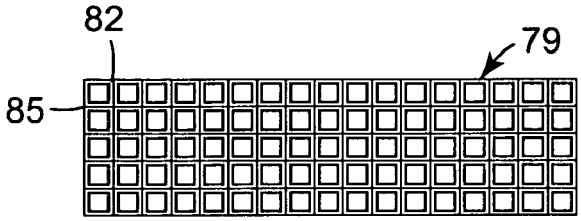
FIG. 2A is a top plan view of the product made with the process shown in FIG. 1A.
Figure 2B:
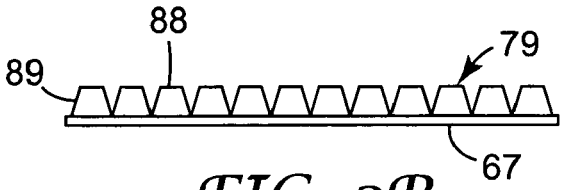
FIG. 2B is a side view of the product shown in FIG. 2A.

Compacted layer 81 is passed between shaping roll 75 and chilled roll 76, which form curable shaped structures (not shown, but typically similar in shape to the corresponding shaped abrasive structures, for example, as shown in FIGS. 2A and 2B) in compacted layer 81. In some embodiments, shaping roll 75 may have a pattern of cutting blades edges outwardly disposed thereon, and that are positioned to at least partially cut through compacted layer 81. In other embodiments, shaping roll 75 may comprise an embossing roll having a pattern of cavities therein; for example, fitted with cutting edges to provide an embossed surface and a pattern of cuts to compacted layer 81, for example, as described in FIGS. 2-4 of U.S. Publ. Pat. Appl. No. 2005/0130568 A1 (Welygan et al.), the disclosure of which is incorporated herein by reference.

In some embodiments, the cutting blades or cutting edges on shaping roll 75 are tapered, and are sufficient to at least partially cut the cohesive layer of curable binder precursor and abrasive particles to the backing to provide a collection of curable shaped structures which are adjacent at the base and separated at the top.

Optionally, at this point, the curable shaped structures may be calendered (e.g., to flatten the tops of the curable shaped structures) or embossed with secondary features into the top surface of the original curable shaped structures (e.g., to create raised and depressed areas on the distal ends of the curable shaped structures). In the event that heat loss precludes this, secondary heaters (e.g., IR heaters) may be used to reheat the surface to allow any additional near surface shape changes.

If backing 67 comprises a scrim, optional carrier 60 may be separated from backing 67 at this point and wound onto optional take up roll 59. Backing 67 and embossed compacted layer 84 are then passed through oven 77 to provide structured abrasive article 79. Structured abrasive article 79 is then taken up onto takeup roll 83 where it can be converted into further products.

FIG. 2A is a top plan view of a product made by the process shown in FIG. 1A. It will be noted that cut lines 85 and 82 intersect to provide shaped abrasive structures 79 having distal ends 88 on backing 67 as depicted in FIGS. 2A and 2B.

Any backing may be used, however, typically the backing has at least some flexibility. Useful flexible backings include, for example, flexible polymeric film and primed polymeric film, metal foil, woven fabrics, knit fabrics, stitchbonded fabrics, paper, flexible vulcanized fibre, nonwoven fabric, calendered nonwoven fabric, open cell foam, closed cell foam, treated versions of the foregoing, and combinations thereof. Also, useful are less flexible backings including, for example, stiff vulcanized fibre, stiff polymeric sheet, glass or metal fabric or sheet, metal or ceramic plate, treated versions of the foregoing, and combinations thereof. As mentioned above, the backing may have one or more treatments thereon, which treatment(s) may cover at least a portion of the first major surface. Examples of such treatments include uncured, partially cured, or cured primers, tie layers, saturants, presizes, and backsizes. Details concerning curable primers that are useful for adhering the shaped structures to the backing may be found in, for example, U.S. Publ. Pat. Appl. No. 2005/0130568 A1 (Welygan et al.).

The backing may be porous or nonporous. In some embodiments, the backing is a scrim. In such embodiments, it is typically desirable to support the scrim on a carrier to prevent the particulate curable binder precursor from passing through the scrim and creating processing problems.

The scrim may comprise an open mesh selected from the group consisting of woven, nonwoven, or knitted fiber mesh; synthetic fiber mesh; natural fiber mesh; metal fiber mesh; molded thermoplastic polymer mesh; molded thermoset polymer mesh; perforated sheet materials; slit and stretched sheet materials; and combinations thereof.

In some embodiments, the scrim may be made of natural or synthetic fibers, which may be either knitted or woven in a network having intermittent openings spaced along the surface of the scrim. The scrim need not be woven in a uniform pattern but may also include a nonwoven random pattern. Thus, the openings may either be in a pattern or randomly spaced. The scrim network openings may be rectangular or they may have other shapes including a diamond shape, a triangular shape, an octagonal shape or a combination of shapes.

Any of a variety of materials are suitable for use as the carrier, including for example heat resistant polymeric films, metal foils, woven fabrics, knit fabrics, stitchbonded fabrics, paper, vulcanized fiber, nonwoven fabrics, calendered nonwoven fabrics, treated versions thereof, and combinations thereof. The thickness of a carrier is generally not important as long as it has sufficient integrity to be separated from the scrim, and is not so stiff that it cannot be used in the process of the present invention.

Abrasive products prepared according to the method of the present invention typically comprise at least one shaped structure that includes a plurality of abrasive particles dispersed in at least partially cured curable binder precursor. The abrasive particles may be uniformly dispersed in a binder or alternatively the abrasive particles may be non-uniformly dispersed therein. It is desirable that the abrasive particles are uniformly dispersed in the binder so that the resulting abrasive product has a more consistent cutting ability.

The average particle size of the abrasive particles, taken collectively, is typically in a range of from about 0.1, 1, 5, or 10 micrometers up to 45 micrometers, although other smaller average particle sizes may also be used. The size of the abrasive particle is typically specified to be the longest dimension of the abrasive particle. In most cases there will be a range distribution of particle sizes. In some instances, the particle size distribution may be tightly controlled, for example, such that the resulting abrasive article provides a consistent surface finish on the workpiece being abraded.

Exemplary abrasive particles include fused aluminum oxide, natural crushed aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, glass, glass ceramics, emery, diamond, hard particulate polymeric materials, metals, sol gel abrasive particles and the combinations thereof. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), the disclosures of which are incorporated herein by reference.

The term abrasive particle, as used herein, also encompasses single abrasive particles bonded together with a polymer, a ceramic, or a glass to form an abrasive agglomerate. Abrasive agglomerates are further described in U.S. Pat. No. 4,311,489 (Kressner); U.S. Pat. No. 4,652,275 (Bloecher et al.); U.S. Pat. No. 4,799,939 (Bloecher et al.), and U.S. Pat. No. 5,500,273 (Holmes et al.), the disclosures of which are incorporated herein by reference. Alternatively, the abrasive particles may be bonded together by inter-particle attractive forces.

Abrasive particles may also have a shape associated with them. Examples of such shapes include rods, triangles, pyramids, cones, solid spheres, hollow spheres and the like. Alternatively, the abrasive particle may be randomly shaped.

Abrasive particles may be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the adhesion of the abrasive particles to the curable binder precursor. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.), the disclosures of which are incorporated herein by reference.

One or more fillers may be combined with the particulate curable binder precursor and abrasive particles to, after further processing, provide abrasive structures that further comprise filler. A filler is a particulate material of any shape, regular, irregular, elongate, plate-like, rod-shaped and the like with an average particle size range between 0.001 to 45 micrometers, typically between 1 to 30 micrometers. Fillers may function as diluents, lubricants, grinding aids or additives to aid powder flow.

Examples of useful fillers for this invention include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, aluminum trihydrate, carbon black, metal oxides (such as calcium oxide, aluminum oxide, tin oxide, titanium dioxide), metal sulfites (such as calcium sulfite), thermoplastic particles (e.g., such as particles of polycarbonate, polyetherimide, polyester, polyamide, polyethylene, poly(vinyl chloride), polysulfone, polystyrene, acrylonitrile-butadiene-styrene block copolymer, polypropylene, acetal polymers, or polyurethanes) and thermosetting particles (e.g., such as phenolic bubbles, phenolic beads, or polyurethane foam particles). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metal fillers include, tin, lead, bismuth, cobalt, antimony, cadmium, iron, and titanium. Other miscellaneous fillers include sulfur, organic sulfur compounds, graphite, lithium stearate and metallic sulfides. Any combination of two or more of the foregoing fillers may also be used.

The shaped structures of abrasive articles prepared according to the present invention are typically formed from a particulate room-temperature solid, sinterable curable binder precursor in a mixture with abrasive particles. The particulate curable binder precursor typically comprises organic thermosetting and/or thermoplastic material, although this is not a requirement. Suitable particulate curable binder precursors are typically capable of softening on heating to provide a curable liquid capable of flowing sufficiently so as to be capable of at least partially wetting either an abrasive particle surface or the surface of an adjacent curable binder precursor particle (e.g., sintering).

The particulate curable binder precursor may be any suitable type consistent with the requirement that it is capable of providing satisfactory abrasive particle bonding and being activated or rendered tacky at a temperature which avoids causing substantial heat damage or disfiguration to the backing. Useful particulate curable binder precursors meeting this criteria include thermosetting particulate materials, thermoplastic particulate materials, thermosetting/thermoplastic hybrid particulate materials, mixtures of thermosetting particulate materials and thermoplastic particulate materials, and mixtures thereof.

Thermosetting particulate materials involve particles made of a temperature-activated thermosetting resin. Such particles are typically used in a solid granular or powder form. The first or short-term effect of a temperature rise sufficiently above the glass transition temperature is softening of the material into a flowable fluid-like state. This change in physical state allows the resin particles to mutually wet or contact the backing and abrasive particles. In this softened state, the cohesive layer may be modified in shape by, for example, calendering, cutting, or embossing. Prolonged exposure to a sufficiently high temperature triggers a chemical reaction, which forms a cross-linked three-dimensional molecular network. The thus solidified (cured) resin particle locally bonds abrasive particles and structures to the surface of the backing.

Useful thermosetting particulate curable binder precursors include, for example, phenolic resins, epoxy resins, polyester resins, copolyester resins, polyurethane resins, polyamide resins, and mixtures thereof. Useful temperature-activated thermosetting materials include formaldehyde-containing resins, such as phenol formaldehyde, novolac phenolics and especially those with added crosslinking agent (e.g., hexamethylenetetramine), phenoplasts, and aminoplasts; unsaturated polyester resins; vinyl ester resins; alkyd resins, allyl resins; furan resins; epoxies; polyurethanes; cyanate esters; and polyimides. Useful thermosetting resins include the thermosetting powders disclosed, for example, in U.S. Pat. No. 5,872,192 (Kaplan, et al.) and U.S. Pat. No. 5,786,430 (Kaplan, et al.), the disclosures of which are incorporated herein by reference.

To prevent heat damage or distortion to the backing, the cure temperature of the thermosetting particle typically will be below any temperature that will cause damage or deformation of the backing constituents.

Useful thermoplastic particulate curable binder precursors may include particulate forms of: polyolefin resins such as polyethylene and polypropylene; polyester and copolyester resins; vinyl resins such as poly(vinyl chloride) and vinyl chloride-vinyl acetate copolymers; polyvinyl butyral; cellulose acetate; acrylic resins including polyacrylic and acrylic copolymers such as acrylonitrile-styrene copolymers; and polyamides (e.g., hexamethylene adipamide, polycaprolactam), co-polyamides, and combinations thereof.

In the case of semi-crystalline thermoplastics (e.g., polyolefins, hexamethylene adipamide, and polycaprolactam), the particulate curable binder precursor may be heated to at least their melting point, whereupon they typically become molten to form a flowable fluid.

If non-crystallizing thermoplastics are used (e.g., vinyl resins and acrylic resins), they are typically heated above the glass transition temperature and rubbery region until the fluid flow region is achieved.

Useful particulate curable binder precursors also include mixtures and blends of the foregoing thermosetting and thermoplastic particulate curable binder precursors.

The size of the particles of curable binder precursor is not particularly limited. In general, the average particle size is less than about 1000 micrometers in diameter, for example, less than about 500 micrometers in diameter. Generally, the smaller the size of the particles of curable binder precursor, the more efficiently they may be rendered flowable because the surface area of the particles will increase as the materials are more finely divided.

The amount of particulate curable binder precursor used in the particulate curable binder precursor-abrasive particle mixture generally will be in the range from about 5 weight percent to about 99 weight percent particulate curable binder material, with the remainder about 95 weight percent to about one percent comprising abrasive particles and optional fillers. Typically, proportions of the components in the mixture are about 10 to about 90 weight percent abrasive particles and about 90 to about 10 weight percent particulate curable binder material, and more typically about 50 to about 85 weight percent abrasive particles and about 50 to about 15 weight percent particulate curable binder material, although this is not a requirement. The permanent shaped structures may include voids, which range from about 5 to about 60 percent by volume.

The particulate curable binder precursor may include one or more optional additives selected from the group consisting of grinding aids, fillers, wetting agents, chemical blowing agents, surfactants, pigments, coupling agents, dyes, initiators, energy receptors, and mixtures thereof. The optional additives may also be selected from the group consisting of potassium fluoroborate, lithium stearate, glass bubbles, inflatable bubbles, glass beads, cryolite, polyurethane particles, polysiloxane gum, polymeric particles, solid waxes, liquid waxes and mixtures thereof. Optional additives may be included to control particulate curable binder precursor porosity and erosion characteristics.

As the backing with the layer of particulate curable binder precursor and abrasive particles is heated the particulate curable binder material sinters to form a cohesive layer. The amount of sintering may progress along a continuum, for example, as the layer of particulate curable binder precursor and abrasive particles travels along a heated platen. In this case, lesser amounts of sintering may be observed at the initial portion of the heated platen with the amount of sintering increasing with distance traveled. Typically, a fairly high level of sintering before compacting is desirable. For example, the layer of particulate curable binder precursor and abrasive particles may be at least 50, 75, 85, 90 percent by weight sintered, or more, before compacting. Heating may be achieved by any suitable means including, for example, infrared heating, a heated platen, an oven, a heated roll, a heated belt, or a combination thereof.

Compacting of the cohesive layer of the mixture of particulate curable binder precursor and abrasive particles is typically accomplished by a compacting roll, although other means of compacting may also be used such as, for example, pressing. The location of compaction and amount of compaction that is necessary for crack reduction or elimination will typically vary with the particular composition of the mixture of particulate curable binder precursor and abrasive particles. The location for compaction is typically selected such that it is prior to the observed onset of cracking of the cohesive layer as it is heated, for example, by a heated platen or IR oven. The amount of compaction may be readily determined, for example, by starting at minimal compacting pressure, and then increasing the compacting pressure until the desired degree of shrinkage crack reduction (typically elimination of shrinkage cracks) is achieved. With too little compacting pressure, the cohesive layer will retain cracks, while at too high a compacting pressure, it may be squashed to a width that is substantially wider than the backing. The compacting roll may be of any material that can impart sufficient compaction force to the cohesive layer. Examples of suitable compacting rolls include metal rolls (e.g., smooth or textured), rubber rolls, and metal rolls having a polymeric sleeve (e.g., of polytetrafluoroethylene or polyimide). The compacting roll may be temperature controlled. It is found that a 10-cm diameter compacting roll operated with a compacting force of from about 6.5 to 12 kilograms per 8.9 centimeters of width of the cohesive layer gives satisfactory results in many cases.

While compacting may optionally also be carried out after forming the curable shaped structures, such compaction alters the original shape of the curable shaped structures. Accordingly, at least some compaction of the cohesive layer is carried out prior to forming the curable shaped structures.

While embossing and/or cutting may be accomplished using a roll or wheel (or a combination of rolls and/or wheels), it may also be accomplished by other suitable means such as, for example, die stamping, by hand. Suitable embossing rolls having cutting edges may be found in, for example, U.S. Publ. Pat. Appl. No. 2005/0130568 A1 (Welygan et al.). Rolls or wheels having embedded outwardly extending cutting blades (e.g., resembling a pizza cutter) arranged, for example, in a desired pattern may also be used. In general, whichever technique is used, it should ultimately result, after at least partial curing, in discrete shaped abrasive structures. Typically, this means that the cutting edge or blade should penetrate the cohesive layer until the backing is substantially reached, although in some cases it may be necessary only to penetrate a portion of the thickness of the cohesive layer (e.g., thereby providing score lines in the cohesive layer that, after at least partial curing of the curable binder precursor, and upon flexing of the cured abrasive article result in fracture lines).

The curable shaped structures comprise a plurality of abrasive particles mixed with particulate curable binder material, but may include other additives such as coupling agents, fillers, expanding agents, fibers, antistatic agents, initiators, suspending agents, photosensitizers, lubricants, wetting agents, surfactants, pigments, dyes, UV stabilizers, powder flow additives and suspending agents. The amounts of these additives are selected to provide the properties desired.

Abrasive particles may further comprise surface modification additives including wetting agents (also sometimes referred to as surfactants) and coupling agents. A coupling agent can provide an association bridge between the polymer binder precursors and the abrasive particles. Additionally, the coupling agent can provide an association bridge between the binder and the filler particles. Examples of coupling agents include silanes, titanates, and zircoaluminates.

Abrasive articles prepared according to the method of the present invention comprise shaped abrasive structures. The term "shaped" in combination with the term "structures" refers to both "precisely shaped" and "irregularly shaped" structures. An abrasive article of this invention may contain a plurality of such shaped abrasive structures in a predetermined array (ordered pattern) on a backing. Alternatively, the shaped abrasive structures may be in a random placement (random pattern) or an irregular placement on the backings. Typically, the shaped structures should be closely packed in a tessellated arrangement across the surface of the backing, although this is not a requirement.

The form of shaped structures (e.g., curable shaped structures and shaped abrasive structures) may be any of a variety of geometric configurations. For example, cross-sections of shaped structures taken parallel to the backing can be square, rectangular, hexagonal, triangular, or a combination thereof, for example, depending upon the design of the shaping roll. In some embodiments, shaped structures may have a shape selected from the group consisting of three-sided pyramids, truncated three-sided pyramids, four-sided pyramids, truncated four-sided pyramids, rectangular blocks, cubes, erect ribs, erect ribs with rounded distal ends, polyhedrons, and mixtures thereof. The cross-sectional shape of shaped structures at the base may differ from the cross-sectional shape at the distal end. For example, the sides forming shaped structures may be perpendicular relative to the backing, tilted relative to the backing or tapered with diminishing width toward the distal end. The transition between these shapes may be smooth and continuous or may occur in discrete steps. A shaped structure with a cross section that is larger at the distal end than at the attachment end may also be used, although fabrication may be more difficult. Shaped structures may also have a mixture of different shapes.

The height of each shaped structure is typically substantially the same, but it is possible to have shaped structures of varying heights in a single abrasive article. The height of the shaped structures generally may be less than about 20 mm, for example, in a range of from about 0.1 to 20 mm, or about 1 to about 15 mm, and even more typically about 8 to about 12 mm. The width of the shaped structure generally ranges from about 0.25 to 25 mm or more, for example, between about 10 to 20 mm, although other widths may also be used.

The base of the shaped structures may abut one another or, alternatively, the bases of adjacent shaped abrasive structures may be separated from one another by some predetermined, typically small, distance.

The areal density of the shaped abrasive structures typically is in a range of from 1000 to 70000 shaped structures/meter$^2$, for example, 5000 to 50000 shaped structures/meter$^2$, or 5000 to 25000 shaped structures/meter$^2$, although densities outside of these ranges may be used. The linear spacing may be varied such that the concentration of structures is greater in one location than in another. The linear spacing of structures typically ranges from about 0.4 to 10 structures per linear cm, for example, between 0.5 to about 8 structures per linear cm, although spacings outside of these ranges may be used. The percentage bearing area may range from about 5 to about 95 percent, typically from about 10 percent to about 80 percent, for example, from about 25 percent to about 75 percent, or even from about 30 percent to about 70 percent. The percent bearing area is the sum of the areas of the distal ends times 100 divided by the total area, including open space, of the backing upon which the shaped abrasive structures are deployed.

Additional coatings may be applied over at least a portion of the shaped structures. Such coatings, also known as "size" coatings, may be compositionally the same as or different from that of the structures to which they are applied. Optional additional coatings may be: particulate or liquid in nature, thermoplastic or thermosetting, inorganic or organic. Such coatings may be applied from solution, or dispersion, or may be 100 percent solids coatings. Such coatings may or may not include additional abrasive particles, abrasive agglomerates, or abrasive composites. Examples of suitable coatings include reinforcing resins, lubricants, grinding aids, colorants, or other materials as such to modify the performance or appearance of the structures.

The embossed/cut cohesive layer may optionally be further compacted, for example, as discussed hereinabove prior to curing.

Curing of the binder precursor may be accomplished by a suitable method including, for example, by IR heaters, heated rolls, or ovens, typically with the choice of curing conditions being dictated by the particular binder precursor and backing used. The choice of such conditions is well within the capabilities of one of ordinary skill in the art.

Optionally, the cured abrasive may be flexed, for example, to provide separation between adjacent shaped abrasive structures.

Figure 3:
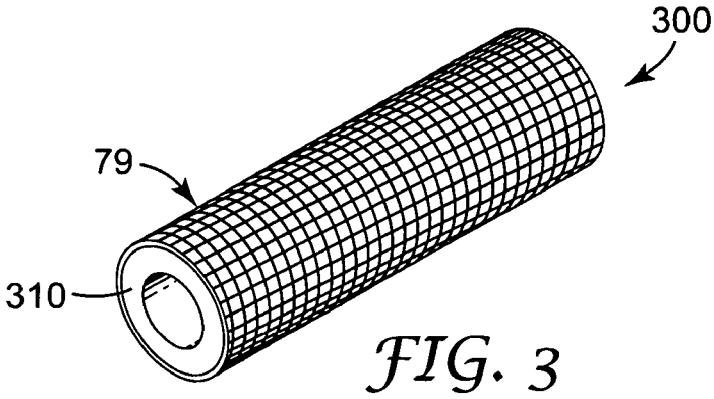
FIG. 3 is a perspective view of an exemplary rotatable structured abrasive article prepared according to one embodiment of the present invention.

Abrasive articles prepared according to the present invention may be cut into disks or into strips to make abrasive belts. Abrasive articles prepared according to the present invention are well suited for incorporation into rotatable abrasive articles such as for example, wheels, sleeves, and rollers. For example, as shown in FIG. 3 it is possible to spirally wind structured abrasive article 79 onto core 310 such that the backing contacts the core thereby forming rotatable abrasive sleeve 300.

Useful cores include, for example, fiber cores, fiber reinforced cores, metal cores, plastic cores, foam cores, and combinations thereof (e.g., a fiber reinforced core having a layer of foam sleeve thereon). Cores may be solid (e.g., a hub or shaft) or hollow (e.g., a tube).

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

TABLE OF ABBREVIATIONS

| | |
|---|---|
| Carrier 1 | woven, rayon fabric, available from Milliken and Company, Spartanburg, South Carolina under the trade designation "101 × 62, 2.08 yd/lb, PFC TENCEL LYOCELL JEANS, 1537 mm width" |
| Scrim 1 | fabric scrim available from Milliken & Company, style #924856 (32 × 28, ends × picks; 65/35 cotton polyester blended warp and fill) |

-continued

TABLE OF ABBREVIATIONS

| | |
|---|---|
| Backing A | Woven fabric available from Milliken & Company, Spartanburg, South Carolina, 76 × 48, 1.25 yd/lb (at 65% R.H.), 65/35 polyester/cotton open end drills, 64.75 inches wide |
| Backing B | a woven polyester fabric available from Milliken & Company, Spartanburg, South Carolina, 101 × 43, 1.15 yd/lb, polyester sateen, high tenacity, dry heat set, 55.75 inches wide" |
| Mineral A | 800 grit green silicon carbide commercially available from Fujimi Corporation, Elmhurst, Illinois under the trade designation "GC800" |
| Mineral B | 320 grit FEPA graded black silicon carbide |
| Mineral C | 80 grit FEPA graded heat-treated aluminum oxide available from Treibacher, Villach, Austria |
| Powder A | thermosetting, copolyester, adhesive powder, commercially available from EMS-CHEMIE (North America), Sumter, South Carolina, under the trade designation "GRILTEX D1644E P1" |
| Powder B | thermoplastic copolyester adhesive powder, commercially available from EMS-CHEMIE (North America) under the trade designation "GRILTEX D1441E P1" |
| Powder C | potassium tetrafluoroborate, commercially available from Atotech UDSA, Inc. Rock Hill, South Carolina, under the trade designation "FLUOROBORATE SPEC. 104" |
| Powder D | thermoset epoxy powder, commercially available from 3M Company under the trade designation "SCOTCHKOTE 6258" |
| Resin A | polymethylene polyphenylisocyanate that contains MDI available under the trade designation "PAPI 94" from Dow Chemical Co., Midland, Michigan |
| Resin B | oligomeric diamine, commercially available from Air Products and Chemicals, Allentown, Pennsylvania, under the trade designation "VERSALINK P1000" |

Example 1

A particulate curable binder precursor-abrasive particle mixture was prepared by combining 1200 parts of Powder D with 2800 parts of Mineral A. The mixture was blended with an industrial mixer (obtained under the trade designation "TWIN SHELL DRY BLENDER" from Patterson Kelly Co., East Stroudsburg, Pa.) for 60 minutes.

Carrier 1 was unwound from a tension controlled unwind and threaded through the apparatus illustrated in FIG. 1A and wound on a speed and tension controlled product winder. Scrim 1 was unwound from another tension controlled unwind and threaded through the apparatus of this invention on top of Carrier 1 and wound on another speed and tension controlled product winder. A portion of the particulate curable binder-abrasive mixture was directed into a trough behind the knife-coating blade.

The knife-coating blade of the particulate curable binder precursor-abrasive knife coating station was adjusted to a width of 2.6 inches (6.6 cm) and a gap of 0.286 inch (0.726 cm) above Scrim 1 to form a layer of particulate curable binder precursor-abrasive mixture on the surface of the backing as it was being carried forward at a speed of 2.2 ft/minute (0.67 m/minute).

The layer of particulate curable binder precursor-abrasive mixture was made cohesive by passing it across a 72-inch (1.8 m) heated platen adjusted to provide a temperature profile over its 5 equal-length heating zones with zone 1 set to 320° F. (160° C.), zone 2 set to 310° F. (154° C.) and zones 3-5 set to 250° F. (121° C.).

A compacting roll was located above the heated platen and allowed to come into contact with the cohesive layer of curable binder precursor-abrasive mixture. The compacting roll was a silicone rubber covered aluminum roll that could spin free on its shaft and was supported by pivot arms. The contact point of the compacting roll with the cohesive layer of curable binder precursor-abrasive mixture was 48 inches (1.2 m) from the start of the platen. The compacting roll had a diameter of 3.88 inches (9.9 cm). The downward force (i.e., dead weight) of the compacting roll was 6.5 kg/3.5 inches (6.5 kg/8.9 cm).

The embossing station consisted of two synchronized driven rolls, the upper roll having 11 parallel disks 5 inches in diameter, about 0.062 inch (1.6 mm) thick, ground to a knife edge and spaced 0.620 inch (1.6 cm) apart. A series of radial slots slightly smaller than 0.0625 inch (1.6 mm) wide were cut into these disks, spaced about 0.500 inch (1.3 cm) along the circumference. A series of rectangular blades also 0.062 inch (1.6 mm) thick and ground to the same knife edge were inserted into the aligned slots of these disks such that the tip of the longitudinal blades were at the same level as the tip of the disks. The assembly resembled a paddle wheel and provided a rotary cookie cutter action. The lower roll was a 5-inch (13 cm) diameter chilled steel roll that was capable of being temperature controlled. The roll was adjusted to provide a temperature of about 42° F. (5.6° C.).

Within 48 inches (1.2 m) downstream of leading edge of the heated platen, the particulate curable binder precursor-abrasive particle mixture became sufficiently softened that when the compacting roll was allowed to come in contact with the surface of the knife coated layer, minimal powder transfer occurred to the compacting roll, yet the surface layer was near the point of fusion. At this point, no cracks in the knife-coated layer were present.

If compaction was not allowed at this point, subsequent movement of the powder bed downstream resulted in cracking of the fusing powder bed. With compaction at this point, no cracking of the bed after the compaction point was observed.

The still softened sheet of compacted curable binder precursor-abrasive mixture was then cut by the rotary cutter to form shaped structures that were rectangular with nominal dimensions of about 0.535 inch (1.36 cm) by 0.390 inch (0.99 cm), with spaces between the structures generally being the width of either the disks or the taper caused by the radial orientation of the blades. Minimal embossing pressures were needed to emboss/cut the fused but softened thermoplastic sheet. Carrier 1 was separated from Scrim 1 immediately after the embossing/cutting process. A minimal quantity of binder-abrasive mixture passed through Scrim 1 to adhere to Carrier 1. Both Scrim 1 and Carrier 1 were wound onto respective winders.

Scrim 1 with the attached shaped structures was passed through a 30-foot (9.1 m) circulating air oven set at 390° F. (199° C.), at a speed of 2.0 feet/min (61 cm/min). The resulting abrasive product after curing was about 6.2 mm thick and weighed about 34.2 g/46.5 mm×88 mm. The void volume of an individual shaped abrasive structure was 33 percent based on the total volume of the shaped abrasive structure. The shaped abrasive structures had a shore D hardness of 87. The density of an individual shaped abrasive structure was 1.58 g/cm$^3$.

The abrasive product was turned mineral side down so that Scrim 1 was exposed. A polyurethane adhesion promoter was painted on the exposed scrim. The polyurethane adhesion promoter was prepared by mixing 28.69 grams of Resin A with 100 grams of Resin B. The promoter was applied with a flexible metal blade and cured for 3 hours at room temperature (cured coating weight=660 grams/meter$^2$). The cured product with the polyurethane adhesion promoter was then slit to constant width (2 units wide) and cut to length of about 55 inches (140 cm). A phenolic core having a 3-inch (7.6 cm) inside diameter, 5 mm wall thickness, and about 13 inches (33 cm) long was coated with a thin layer of liquid polyurethane adhesive over the central 9 inches (23 cm) of the core. The polyurethane adhesive was prepared by mixing 10.25 g of Resin A with 35.24 g of Resin B.

Annular rings of flexible ethylene vinyl acetate foam having a density of 0.0442 g/cm$^3$, an inner diameter of 3.4 inches (8.6 cm), an outer diameter of 6 inches (15 cm), and 3 inches (7.6 cm) long were purchased from Illbruck, Minneapolis, Minn., under the designation "L300". Three of these rings were slit radially and slipped over this liquid polyurethane adhesive coated core and allowed to cure 3 hours at room temperature after being secured with tape to maintain contact with the adhesive. The cured rings were then dressed to constant diameter after curing.

The same liquid/polyurethane adhesive was then used to coat the outside diameter of the foam rings now firmly attached to the core with a liquid layer about 0.5 mm thick. The polyurethane adhesive was allowed to partially cure so that a wood tongue depressor when contacting the surface would come away with resin attached to the stick and the resin would form a curtain while pulling away. This partial cure typically took about 40 minutes. The previously mentioned cured strip having the shaped abrasive structures with the adhesion promoter was then spirally wrapped around the partially cured polyurethane coated foam. The strip was held in place with tape and the complete assembly allowed to cure for 3 hours at room temperature. Excellent adhesion between the abrasive strip and the foam assembly was achieved. The final abrasive article was then dressed with a diamond tool to ensure concentricity.

The resultant rotatable abrasive article was useful as a finishing tool for removing irregularities in the printed circuit board manufacturing process.

Effect of Particle Size on Cracking

A particulate curable binder precursor-abrasive particle mixture was prepared by combining 80 grams of Powder D with 120 grams of Mineral B. The mixture was thoroughly blended in a plastic container by vigorous shaking for 60 seconds.

A primer mixture was prepared by mixing Powder A with Powder B in the weight ratio of 40:60. The primer mixture was thoroughly blended in an industrial V-Blend mixer for 12 minutes. The primer mixture was knife coated onto Backing A at a nominal thickness of 0.010 inch (0.025 cm) and passed across a 72-inch (1.8-m) platen heated at 260° F. (127° C.) at a speed of 7 feet per minute (2.1 m/min), whereupon it was fused to the backing.

Backing A coated with the primer mixture was unwound from a tension controlled unwind and threaded through the apparatus arranged as illustrated in FIG. 1A and wound on a speed and tension controlled product winder. A portion of the particulate curable binder precursor abrasive particle mixture was directed into a trough behind the knife-coating blade. The knife coating blade of the particulate curable binder precursor-abrasive knife coating station was adjusted to a width of 3.0 inches (7.6 cm) and a gap of about 0.122 inch (0.31 cm) above Backing A to allow the particulate curable binder precursor-abrasive mixture to be deposited on the surface of the backing as it was being carried forward at a speed of about 3.0 feet/minute (0.91 m/min).

A 72-inch (1.8 m) heated platen was adjusted to provide a temperature profile over its 5 equal-length heating zones with zones 1-3 set to 350° F. (177° C.), zone 4-5 set to 300° F. (149° C.). A compacting roll was located above the curing platen and allowed to come in contact with the surface of the platen. The compacting roll was a silicone rubber covered aluminum roll that could spin free on its shaft and was supported by pivot arms. The contact point of the compacting roll with the platen was 18 inches (0.46 m) from the start of the platen. The compacting roll had a diameter of 3.88 inches (9.9 cm). The downward force (i.e., dead weight) of the compacting roll was 6.5 kg/3.5 inches (6.5 kg/8.9 cm).

Within 18 inches (0.46 m) downstream of leading edge of the platen, the particulate curable binder precursor-abrasive particle mixture became sufficiently softened that when the compacting roll was allowed to come in contact with the surface of the knife coated layer, minimal powder transfer occurred to the compacting roll, yet the surface layer was near the point of fusion. At this point, no cracks in the knife-coated layer were present.

If compaction was not allowed at this point, subsequent movement of the powder bed downstream resulted in cracking of the fusing powder bed. With compaction at this point, no cracking of the bed after the compaction point was observed.

Example 2

Example 1 was repeated with the following changes:

1. The particulate curable binder precursor-abrasive particle mixture was prepared by mixing Mineral C with Powder D and Powder C in the weight ratio 78:15:7. The mixture was thoroughly blended with an industrial V-Blend mixer for 12 minutes.

2. Scrim 1 and Carrier 1 were collectively replaced by Backing B, which was coated with a 0.010 inch (2.5 mm) thick coating of a powdered primer mixture partially fused on a heated platen set at a temperature of 260° F. (127° C.) so that the primer mixture visually appeared to retain its powdery nature, but would not transfer from Backing B to any of the conveying rolls needed to control the web path. The powdered primer mixture was a thoroughly mixed blend of 60 parts resin Powder B and 40 parts resin Powder A.

3. The knife coating blade of the particulate curable binder precursor-abrasive mixture knife coating station was adjusted to a width of 3.3 inches (8.4 cm) and a gap of about 0.250 inch (0.63 cm) above Backing B to allow a layer of particulate curable binder precursor-abrasive mixture to be deposited on the surface of the backing as it was being carried forward at a speed of about 3.8 feet/minute (1.2 m/min).

4. The 72-inch (1.8 m) heated platen was adjusted to provide a temperature profile over its 5 equal-length heating zones with zones 1-3 set to 330° F. (166° C.) and zones 4-5 set to 300° F. (149° C.).

5. After cutting, Backing B with still softened shaped structures thereon was then passed through an additional set of compacting rolls set at a gap of 0.250 inch (0.6 cm) prior to curing.

The resulting product after curing was 0.269 inch (0.683 cm) thick and weighed 71.89 g/67 mm×111 mm. The density of an individual abrasive structure was 1.70 g/cm$^3$. The void volume was 36.5 percent. The shaped abrasive structures had a shore D hardness of about 77.5.

Various modifications and alterations of this invention may be made by those skilled in the art without departing from the scope and spirit of this invention, and it should be understood that this invention is not to be unduly limited to the illustrative embodiments set forth herein.

What is claimed is:

1. A method of making an abrasive product, the method comprising:

a) providing a substantially horizontally deployed backing;

b) providing a dry flowable particle mixture comprising abrasive particles and particulate curable binder precursor, wherein the abrasive particles have an average particle size of 45 microns or less;

c) depositing a layer of the dry flowable particle mixture onto the backing;

d) sintering at least a portion of the layer of the dry flowable particle mixture to provide a cohesive layer wherein adjacent abrasive particles are adhered to one another by the curable binder precursor;

e) compacting the cohesive layer to provide a compacted layer;

f) at least one of embossing or at least partially cutting the compacted layer to provide curable shaped structures having a distal end spaced from the backing and an attachment end adhered to the backing; and g) at least partially curing the curable binder precursor to form shaped abrasive structures comprising abrasive particles and a binder, the shaped abrasive structures being affixed to the backing.

2. A method according to claim 1, wherein the backing comprises a treated backing wherein the at least the first surface of the backing comprises an at least partially cured primer.

3. A method according to claim 1, wherein the backing comprises a scrim.

4. A method according to claim 3, further comprising:

prior to step c)

providing a substantially horizontally deployed carrier; disposing the scrim on the carrier; and prior to step g)

separating the scrim from the carrier.

5. A method according to claim 1, further comprising embossing the distal ends of the curable shaped structures to provide a pattern of raised areas and depressed areas.

6. A method according to claim 1, wherein step f) comprises at least partially cutting the compacted layer.

7. A method according to claim 1, wherein step f) comprises embossing the compacted layer.

8. A method according to claim 1, further comprising flexing the backing after step g).

9. A method according to claim 1, further comprising:

compacting the curable shaped structures.

10. A method according to claim 1, wherein the binder precursor comprises a thermosetting epoxy resin.

11. A method according to claim 1, wherein the height of the shaped abrasive structures in a range of from 0.1 to 20 millimeters.

12. A method according to claim 1, wherein the areal density of the shaped abrasive structures is in a range of from 1000 to 70000 features per square meter.

13. A method of forming an abrasive article according to claim 1, further comprising:

affixing the backing to a core such that the shaped abrasive structures are outwardly disposed relative to the core.

14. A method according to claim 13, wherein the backing is spirally wound on the core.

15. A method according to claim 1, further comprising:

prior to step b)

applying a powdered curable primer to the backing; and sintering the powdered curable primer.

16. A method according to claim 1, wherein step d) comprises sintering at least 90 percent by weight of the layer of the dry flowable particle mixture.

* * * * *